US005902062A

United States Patent [19]

Rosenblatt et al.

[11] Patent Number: 5,902,062

[45] Date of Patent: May 11, 1999

[54] TUBULAR CONTAINER FOR SOLID PRODUCT

[75] Inventors: Jerry H. Rosenblatt, Burlingame, Calif.; Somlak Panascharoen, Bangkok, Thailand

[73] Assignee: French Transit, Ltd., Burlingame, Calif.

[21] Appl. No.: 09/036,532

[22] Filed: Mar. 6, 1998

Related U.S. Application Data

[63] Continuation of application No. 08/729,794, Oct. 8, 1996, abandoned, which is a continuation of application No. 08/429,509, Apr. 26, 1995, abandoned.

[51] Int. Cl.[6] ..... A45D 40/06; A45D 40/04

[52] U.S. Cl. ..... 401/78; 401/68; 401/72; 401/82; 401/86; 401/87

[58] Field of Search ..... 401/78, 87, 86, 401/75, 72, 79, 82

[56] References Cited

U.S. PATENT DOCUMENTS

| | | | |
|---|---|---|---|
| 1,476,965 | 12/1923 | Grant . | |
| 1,510,934 | 10/1924 | Grant . | |
| 1,527,745 | 2/1925 | Miller . | |
| 1,969,331 | 8/1934 | Small | 206/56 |
| 2,022,075 | 11/1935 | Cabrera | 401/78 |
| 2,230,083 | 1/1941 | Montenier | 167/90 |
| 2,333,889 | 11/1943 | Ruekberg | 401/78 |
| 2,509,536 | 5/1950 | Spender | 206/56 |
| 2,626,847 | 1/1953 | Brown | 312/31.1 |
| 2,838,442 | 6/1958 | McMaster | 167/85 |
| 2,890,987 | 6/1959 | Hilfer | 167/90 |
| 3,083,822 | 4/1963 | Clark | 401/78 |
| 3,180,827 | 4/1965 | Martinek et al. | 252/25 |
| 3,817,636 | 6/1974 | Ritzenhoff | 401/78 |
| 4,023,912 | 5/1977 | Mahler et al. | 401/82 |
| 4,139,311 | 2/1979 | Lorscheidt | 401/55 |
| 4,621,935 | 11/1986 | Sussman | 401/82 |
| 5,286,126 | 2/1994 | Harris et al. | 401/82 |
| 5,346,323 | 9/1994 | Harris et al. | 401/82 |
| 5,399,364 | 3/1995 | Verdan | 424/698 |

FOREIGN PATENT DOCUMENTS

| | | | |
|---|---|---|---|
| 217866 | 3/1957 | Australia | 401/78 |
| 946797 | 6/1949 | France | 401/78 |
| 507719 | 1/1953 | Italy | 401/78 |
| 681439 | 10/1950 | United Kingdom . | |
| 651582 | 4/1951 | United Kingdom | 401/78 |
| 2143212 | 2/1985 | United Kingdom | 401/78 |

*Primary Examiner*—Steven A. Bratlie
*Attorney, Agent, or Firm*—Fliesler, Dubb, Meyer & Lovejoy

[57] ABSTRACT

A container for dispensing solid crystal deodorant including an elongated outer tubular member having both of its ends open and an elongated slot longitudinally disposed on its inside surface. An elongated inner tubular member, with at least one open end, is rotably held within the outer tubular member. The inner tubular member has helical grooves. Positioned inside the inner tubular member is a holder suitable for holding a solid crystal deodorant product to extend out from the container. The holder has tabs inserted through the helical grooves and into the elongated slot. The holder also has a plurality of projections extending from its periphery which contact an indentation on the external surface of the crystal deodorant to hold the solid crystal deodorant onto the holder. When the user rotates the inner tubular member relative to the outer tubular member, the Labs are forced to move longitudinally in the helical groove and the slot as the inner tubular member rotates, moving the holder and the deodorant longitudinally relative to the inner and outer tubular members, and thus into or out of the container.

3 Claims, 2 Drawing Sheets

TUBULAR CONTAINER FOR SOLID PRODUCT

This application is a continuation of Ser. No. 08/729,794, filed Oct. 8, 1996, now abandoned, which is a continuation of Ser. No. 08/429,509, filed Apr. 26, 1995 abandoned.

BACKGROUND OF THE INVENTION

The present invention is related to a tube container for dispensing solid products, particularly solid rocklike crystal deodorant.

Crystal rock deodorant is gaining increasing consumer acceptance because of its long life and image as a healthy alternative to conventional antiperspirant. Crystal rock deodorant is made from natural mineral salts and does not contain any moisture. Thus, the user must wet the deodorant with water before it is used, usually by either holding it under a running tap or immersing it in a sink filled with water. Once the deodorant is wet, the user can rub the top of the crystal over the area of the body to which the deodorant is to be applied.

After use, the crystal must be allowed to dry. If water is left on the crystal it will deteriorate by becoming soft. If this happens, the crystal may be unusable in the intended manner.

Push-up dispensers for crystal deodorant may require the user to push down on the top of the crystal deodorant in order to retract the deodorant back into the container. This is disadvantageous because the deodorant is typically wet after it is used, and the user may get the deodorant on his hands when pushing down on the top of the deodorant or must use the lid of the container to push down the deodorant.

Furthermore, if rock crystal deodorant is held in place on a movable platform by a frictional projection inserted into the rock crystal deodorant, a central hole must be formed in the rock crystal during the manufacturing process. If this method of holding the rock crystal deodorant onto a platform is used, the deodorant can be somewhat unstable when it is extended from the tube and a sideways force is applied. Restricting the amount by which the deodorant can be extended from the tube, and thus allowing the inner circumference of the tube to stabilize the product, has the disadvantage of causing a portion of the product to be wasted, as that portion of the product must remain below the top of the container and therefore cannot be used. A longer projection, which might provide more stability, also reduces the useful life of the product, since once the projection extends from the top of the deodorant, the user is prevented from using the product as it is intended. Additional projections into the base of the deodorant crystal require a more complicated manufacturing process as more holes in the deodorant must be provided.

SUMMARY OF THE INVENTION

It is therefore an object of the invention to provide an improved tubular container which is especially suited for dispensing solid crystal deodorants.

It is another object of the invention to provide a container which allows the dispensed product to dry after use.

It is another object of the invention to provide an improved tubular container which allows the crystal rock deodorant to be retracted back into the container without the need for the user to push on the top of the deodorant.

It is another object of the invention to provide a container which allows for the rock crystal to be held in place without the need of a deep hole in the base of the rock crystal deodorant, thus simplifying the manufacturing process.

It is another object of the invention to provide a container which allows for the rock crystal to be held stable and minimizes the amount of the product that cannot be used.

In accordance with one embodiment of the present invention, these and further objectives are achieved in a container suitable for containing a solid crystal deodorant product. The container includes an elongated outer tubular member having a first open end and a second open end and an elongated slot longitudinally disposed on its inside surface. An elongated inner tubular member, having a first open end and a second end, is held within the outer tubular member such that the inner tubular member may be rotated relative to the outer tubular member. The inner tubular member has helical grooves. The container also has a holder suitable for holding a solid crystal deodorant product so that the product extends out from the first open end of the outer tubular member and the first open end of the inner tubular member. The holder has a base, with tabs that are inserted through the helical grooves and into the elongated slot. The holder also has a plurality of projections extending from its periphery which have flanges that engage an indentation on the circumference of the rock crystal deodorant product to hold the product onto the base. The holder, and thus the deodorant product, moves relative to the inner and outer tubular members as the inner tubular member is rotated relative to the outer tubular member.

In accordance with another embodiment of the present invention, a container suitable for containing a solid crystal deodorant product comprises an elongated tubular member having a first open end and a second end, and a holder suitable for holding a solid crystal deodorant product to extend outwardly from the first open end of the tubular member. Said holder has a periphery, and further comprises a plurality of projections extending from the periphery thereof suitable for engaging the solid crystal deodorant product.

DESCRIPTION

The present invention will now be described with reference to embodiments in which the tubular container is used to dispense solid crystal rock deodorant. While a preferred embodiment is described below with reference to a tubular container for rock crystal deodorant, it will be apparent to those of ordinary skill in the art that the container of the present invention could also be used for dispensing other types of solid or semi-solid products. Further, the inventive aspects presented here can be used with both push-up and twist-up dispensers.

The present invention is also described with reference to embodiments in which the tubular containers are generally cylindrical. However, it is contemplated that the container of the present invention may be designed using other geometries than described herein.

Figure 1:
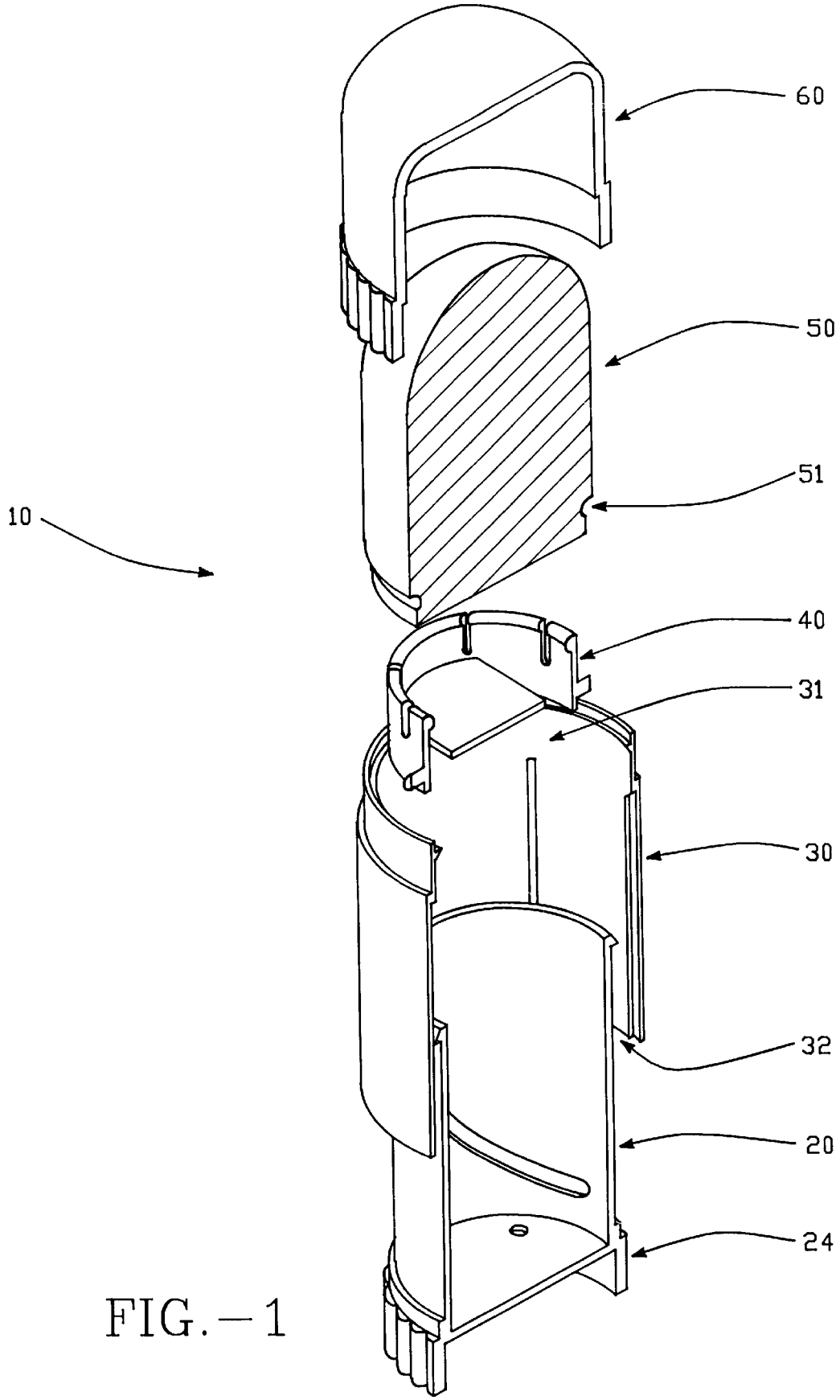
FIG. 1 depicts an exploded sectional view of an embodiment of the invention.

An exploded, sectional view of tubular container 10 in accordance with a preferred embodiment of the invention is shown in FIG. 1. The tubular container 10 includes an inner tubular member 20, outer tubular member 30, a holder 40 for holding solid crystal deodorant 50, and a lid 60.

Figure 2:
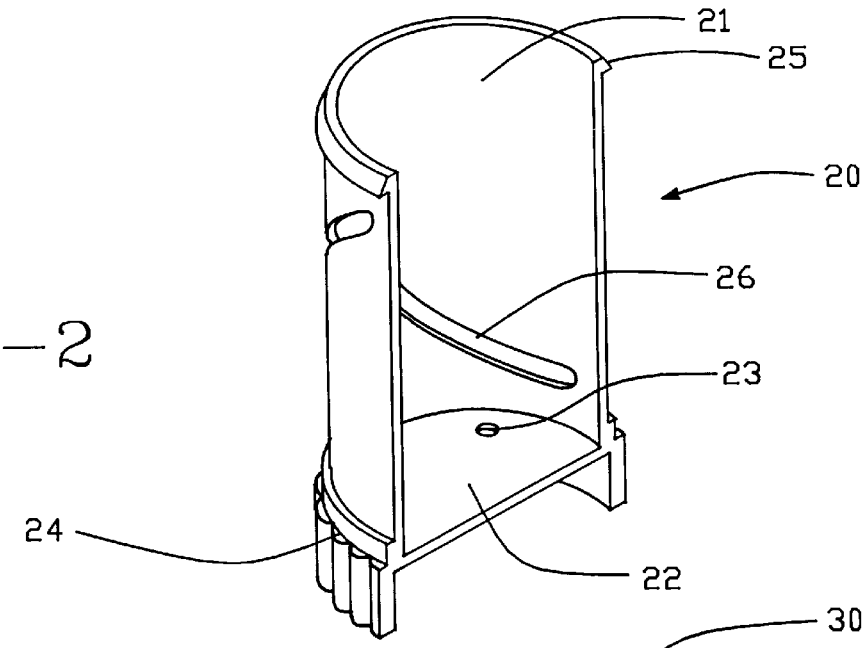
FIG. 2 depicts a sectional view of the inner tubular member in the embodiment shown in FIG. 1.

With reference to FIGS. 1 and 2, the inner tubular member 20 has at least one open end 21. The opposite end 22 of the inner tubular member may be either open or closed; however, if closed, the material blocking the tube may have, if desired, at least one hole 23 to allow water or other fluid to be channelled away from the solid crystal deodorant 50 and allow it to dry.

Figure 3:
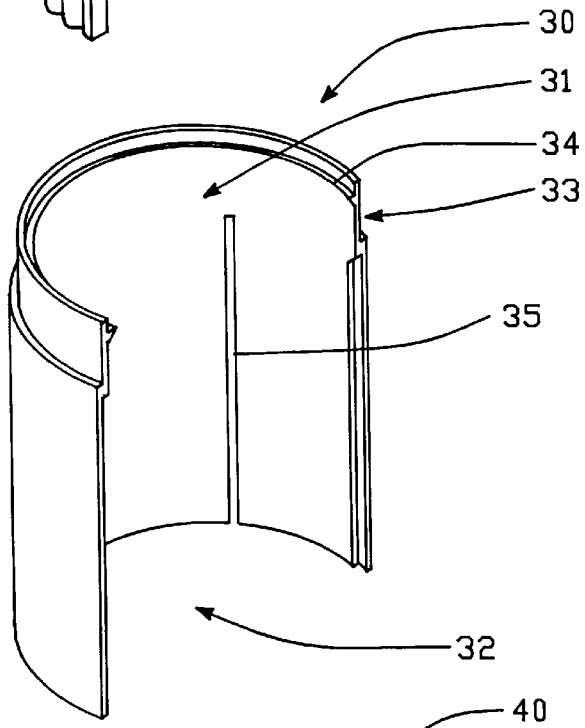
FIG. 3 depicts a sectional view of the outer tubular member in the embodiment shown in FIG. 1.

With reference to FIGS. 1 and 3, the outer tubular member 30 is open at both ends, 31, 32. The outside 33 of the outer tubular member near the end 31, may be of a slightly smaller external diameter than the rest of the tubular member to allow a cap 60 to fit on the end 31. Alternatively, the end 31 may be configured to accept a screw-type cap. The inside circumference of the outer tubular member near the end 31 forms a shallow shelf 34.

The inner tubular member 20 is positioned within the outer tubular member 30 such that a portion of the inner tubular member 20 extends from the end 32 of the outer tubular member 30. The exposed portion 24 of the inner tubular member 20 may have a slightly increased external diameter in comparison with the rest of the inner tubular member 20 so that it has substantially about the same external diameter as the outer tubular member 30. The exposed portion may also be fluted or otherwise textured to make it easier for the user to grasp and turn.

The outside circumference of the end 21 of the inner tubular member 20, opposite the exposed portion 24, is formed with a shallow shelf 25 that rest on and cooperates with the shelf 34 on the inner circumference of the outer tubular member 30, so that the inner tubular member may be rotated relative to the outer tubular member by grasping and turning the exposed portion 24 of the inner tubular member 20. The shelf 25 and the exposed portion 24 insure the outer tubular member 30 to be positioned and held on the inner tubular member 20.

The inner tubular member 20 has two helical grooves or ramps 26, although those of ordinary skill in the art will appreciate that a different number and shape of grooves might be used. In this preferred embodiment, these helical grooves 26 extend completely through the wall of the inner tubular member 20. The helical grooves 26 must be oriented such that they proceed around the circumference of the inner tubular member 20 in the same direction, clockwise or counter-clockwise, toward a particular end of the inner tubular member 20.

The outer tubular member 30 forms two straight slots 35 on the internal wall of the member. The helical grooves 26 and the straight slots 35 are positioned in their respective tubular members such that when one of the helical grooves 26 crosses one of the straight slots 35 at a particular distance from the end 32 of the outer tubular member 30, the other helical groove 26 will cross the other straight slot 35 at substantially same distance.

Figure 4:
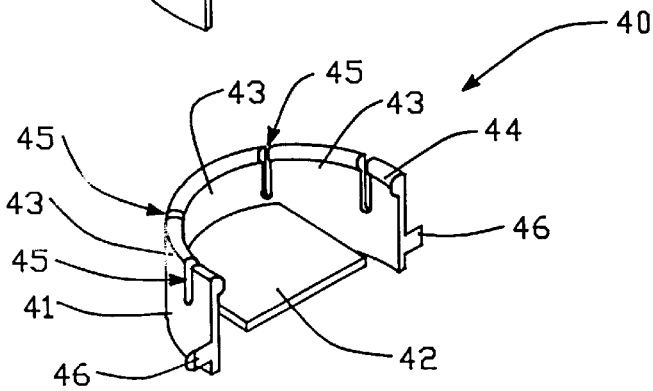
FIG. 4 depicts a sectional view of the holder in the embodiment shown in FIG. 1.

Referring now to FIGS. 1 and 4, the container further includes a holder 40 which is particularly suitable for holding a rock crystal deodorant 50. Although in the preferred embodiment the rock crystal deodorant is substantially cylindrical in shape, those of skill in the art will appreciate that other geometries could be used.

The holder 40 includes an outer wall 41, which is in the shape of a short cylinder with an internal diameter approximately the same as than the external diameter of the rock crystal deodorant product 50. If the external perimeter of the rock crystal deodorant was shaped differently, the internal perimeter of the wall 41 of the holder 40 could be modified to conform to that shape. It should be noted that the external diameters of both the rock crystal deodorant and the holder are slightly smaller than the internal diameter of the inner tubular member 20 to allow the holder 40 and the rock crystal deodorant 50 to be able to move within the inner tubular member 20 and to allow fluid to flow around and away from the crystal deodorant 50.

The holder 40 also includes a floor 42 at one end. The floor 42 does not completely close the end of the holder 40. In the preferred embodiment the floor 42 conforms to the internal perimeter of the wall 41 for only portions of that perimeter, thus forming drainage apertures or gaps along the internal perimeter of the wall 41. Other configurations of gaps or openings are possible. For example, the openings could be created by one or more circular openings, a cross-shaped floor, etc. These gaps or openings in the floor 42 allow fluid to flow out of the holder away from the rock crystal deodorant product and allow air to reach portions of the rock crystal deodorant product 50 which are supported by the floor 42. Thus, this structure limits deterioration of the rock crystal deodorant caused by constant exposure to water.

The wall 41 forms projections 43 which extend away from the floor 42. These projections 43 may be formed so that they are somewhat resilient and thus may be slightly expandable in a radial direction to allow for insertion of and a better purchase on the product. The ends of the projections 43 form inwardly-facing flanges 44. There are gaps 45 between the projections 43 that are large enough to allow fluid to flow through them. This has the advantage of allowing water to flow out of the holder 40 away from the rock crystal deodorant product 50, discouraging deterioration of the rock crystal deodorant.

In use, one end of the cylindrically-shaped rock crystal deodorant product 50 is positioned in the holder 40 so that one end rests on or is near the floor 42 with the projections 43 in contact with the crystal deodorant product 50. Although not required, positioning the rock crystal deodorant product so that its entire end surface does not rest on the floor 42 may increase the ability of the gaps or openings in the floor 42 to channel water away from the product. Further, although not required, spacers (not shown) might be used to create such a gap.

The crystal deodorant product is formed such that it has an indentation 51 around its circumference such that when positioned within the holder the flanges 44 can engage the indentation 51 and thus hold the deodorant product 50 in place. The use of the flanges 44 to hold the deodorant product in place simplifies the overall manufacturing process since it is not necessary to form a hole or holes in the rock crystal deodorant to accept a projection as is a taught in U.S. Pat. Nos. 5,286,126 and 5,346,323. Furthermore, in the present invention the crystal is held in a more stable position on the holder without the need for a separate stabilizing and centering structure within the cylinder such as the fingers shown in those patents.

The holder 40 further includes two tabs 46 extending radially outward from the outer circumference of the holder 40. Each tab 46 is operatively associated with a helical groove 26 and a slot 35. The holder 40 is positioned within the inner tubular member 20, and the inner tubular member 20 and the holder 40 are positioned relative to the outer tubular member 30 such that each tab 46 extends through a helical groove 26 and into a slot 35. Each tab 46 must therefore be of a sufficient length to allow both tabs 46 to engage the slots 35 in this manner. However, the tabs 46 must be short enough and of proper size to allow the holder 40 to be level within the inner tubular member 20 and to permit free movement of the tabs along the slot 35 and the helical groove 26.

In operation, the holder 40, the inner tubular member 20 and the outer tubular member 30 are positioned as described above. The inner and outer tubular members 20, 30 are connected such that the shallow shelf 25 rests on and rotatively cooperates with the shelf 34 on the inner circumference of the outer tubular member 30. When the user grasps and turns the exposed portion 24 of the inner tubular member 20 the tabs 46 are forced to move along the helical groove 26 and along the slot 35, thus moving the holder 40 longitudinally relative to the tubular members 20, 30, with the direction of movement dependent upon the orientation of the helical grooves 26 and the direction the inner tubular member 20 is rotated. As the holder 40 moves, the rock crystal deodorant is forced out of or into the container. The slots 35 hold the holder 40, and thus the deodorant 50, so that they do not rotate relative to the outer tubular member 30.

The foregoing description and figures of the preferred embodiment of the present invention has been provided for the purpose of illustration and description. It is not intended to be exhaustive or to limit the invention to the precise forms disclosed. Many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. A solid crystal rock deodorant product comprising:

a solid crystal rock deodorant with an indentation around a circumference of said deodorant;

a dispenser with a first open end that can dispense said deodorant;

a holder that can hold said solid crystal rock deodorant in said dispenser and allow said crystal rock deodorant to extend outwardly from the first open end of the dispenser and wherein the holder is movable relative to the dispenser;

wherein said holder has a plurality of projections with inwardly-facing flanges that engage the indentation of the solid crystal rock deodorant and the projections are spaced sufficiently to permit liquid to flow therebetween, said holder has a periphery and said projections extend from said periphery toward the first open end of the dispenser, and the inwardly-facing flanges are at distal ends of said projections and are transverse to a direction of travel of the holder toward the first open end of the dispenser; and wherein said inwardly-facing flanges are rounded so that the flanges are smoothly received in the indentation of the solid crystal rock deodorant.

2. A solid crystal rock deodorant product comprising:

a solid crystal rock deodorant with an indentation around a circumference of said deodorant;

a dispenser with a first open end that can dispense said deodorant;

a holder that can hold said solid crystal rock deodorant in said dispenser and allow said crystal rock deodorant to extend outwardly from the first open end of the dispenser and wherein the holder is movable relative to the dispenser;

wherein said holder has a plurality of projections with inwardly-facing flanges that engage the indentation of the solid crystal rock deodorant and the projections are spaced sufficiently to permit liquid to flow therebetween, said holder has a periphery and said projections extend from said periphery toward the first open end of the dispenser, and the inwardly-facing flanges are at distal ends of said projections and are transverse to a direction of travel of the holder toward the first open end of the dispenser;

wherein said inwardly-facing flanges are rounded so that the flanges are smoothly received in the indentation of the solid crystal rock deodorant; and wherein said holder has a floor that forms at least one opening to permit fluid to flow therefrom.

3. A solid crystal rock deodorant product comprising:

a solid crystal rock deodorant with an indentation around a circumference of said deodorant;

an elongated outer tubular member having a first open end and a second open end;

an elongated inner tubular member, having a first open end and a second end, held within the outer tubular member such that the inner tubular member may be rotated relative to the outer tubular member and wherein the second end of the inner tubular member extends outwardly from the second end of the outer tubular member in order to provide a surface that allows the inner tubular member to be gripped and rotated relative to the outer tubular member;

one of said inner tubular member, and said outer tubular member further forming a helical groove, and said other of said inner tubular member and said outer tubular member forming an elongated slot operatively associated with the helical groove;

a holder that can hold said solid crystal rock deodorant and can allow said solid crystal rock deodorant to extend outwardly from the first open end of the outer tubular member and the first open end of the inner tubular member, said holder comprising a tab inserted through the helical groove and into the elongated slot and wherein the holder is movable relative to the inner and outer tubular members as the inner tubular member is rotated relative to the outer tubular member;

wherein said holder has a plurality of projections with inwardly-facing flanges that engage the indentation of the solid crystal rock deodorant and the projections are spaced sufficiently to permit liquid to flow therebetween, said holder has a periphery and said projections extend from said periphery toward the first open end of the outer tubular member, and the inwardly-facing flanges are at distal ends of said projections and are transverse to a direction of travel of the holder toward the first open end of the outer tubular member;

wherein said inwardly-facing flanges are rounded so that the flanges are smoothly received in the indentation of the solid crystal rock deodorant; and wherein said holder has a floor that forms at least one opening to permit fluid to flow therefrom.

* * * * *